US007489283B2

(12) United States Patent
Ingram et al.

(10) Patent No.: US 7,489,283 B2
(45) Date of Patent: Feb. 10, 2009

(54) PHASED ARRAY ANTENNA APPARATUS AND METHODS OF MANUFACTURE

(75) Inventors: Daisy L. Ingram, Cerritos, CA (US); Patrick Bailleul, Whittier, CA (US)

(73) Assignee: The Boeing Company, Chicago, IL (US)

( * ) Notice: Subject to any disclaimer, the term of this patent is extended or adjusted under 35 U.S.C. 154(b) by 151 days.

(21) Appl. No.: 11/615,740

(22) Filed: Dec. 22, 2006

(65) Prior Publication Data

US 2008/0150832 A1 Jun. 26, 2008

(51) Int. Cl.
*H01Q 21/00* (2006.01)

(52) U.S. Cl. ..... 343/853; 343/700 MS; 342/371

(58) Field of Classification Search ..... 343/853, 343/700 MS, 754, 893; 342/371, 372
See application file for complete search history.

(56) References Cited

U.S. PATENT DOCUMENTS 5,162,803 A 11/1992 Chen
5,854,607 A * 12/1998 Kinghorn ..... 343/853
5,907,304 A * 5/1999 Wilson et al. ..... 343/700 MS
6,178,333 B1 1/2001 Feuerstein et al.
6,184,832 B1 * 2/2001 Geyh et al. ..... 343/700 MS
6,232,920 B1 5/2001 Brookner et al.
6,429,816 B1 8/2002 Whybrew et al.
6,650,291 B1 * 11/2003 West et al. ..... 342/371
7,132,990 B2 * 11/2006 Stenger et al. ..... 343/754
7,348,932 B1 * 3/2008 Puzella et al. ..... 343/853

* cited by examiner

*Primary Examiner*—Tho G Phan
(74) *Attorney, Agent, or Firm*—Duke W. Yee; Kevin G. Fields

(57) ABSTRACT

Embodiments include phased array antenna apparatus and methods of manufacturing them. In an embodiment, a phased array antenna apparatus includes at least one printed wiring board (PWB) (1002, FIG. 10) having multiple layers, at least one beamformer module (1014) with at least one beam combiner/divider, at least one amplifier (1016), and at least one integral radiating element (1006). The PWB includes RF manifolds (912, 916, FIG. 9) embedded within the multiple layers between corresponding ports (910, 914) of the beam combiners/dividers. The at least one integral radiating element is located proximate to an edge of the PWB and oriented in parallel with a bore-sight of the phased array antenna apparatus. In an embodiment, the beam combiners/dividers may include an H form combiner (704, FIG. 7). An opening (1026, FIG. 10) in the PWB is adapted to enable the amplifier to directly contact a heat sink (1004), in an embodiment.

20 Claims, 9 Drawing Sheets

PHASED ARRAY ANTENNA APPARATUS AND METHODS OF MANUFACTURE

TECHNICAL FIELD

Embodiments described herein generally relate to phased array antenna apparatus, and more particularly to phased array antenna apparatus having multiple-layer printed wiring boards and methods of manufacture thereof.

BACKGROUND

A phased array antenna system may be used to generate one or more beams, which are steerable and shapeable. In many instances, traveling-wave-tube amplifiers (TWTs) are used with passive antennas to generate shaped or spot beams. With evolving semiconductor technologies and improvements in yield, cost, and reliability of solid-state technologies, phased array systems with solid-state power amplifier (SSPA) elements have become realizable for satellite communications systems.

A multiple-beam, transmit phased array antenna system typically includes a plurality of beam drivers, power dividers, and beamformer modules. In addition, in order to combine the signals associated with the multiple beams, the beamformer modules also include a combiner network (e.g., a Wilkinson combiner network), which combines the individually phase weighted beam signals, and provides composite signals to a plurality of amplifier modules and radiating elements.

Many of these antenna components are interconnected using radio frequency (RF) interconnects (e.g., coaxial interconnects), direct current (DC) interconnects, and control signal interconnects. The structure and arrangement of interconnects depend on the type of phased array antenna configuration. Phased array antenna systems are known to use a multitude of connectors and cables to interconnect system elements.

Two basic types of phased array antenna configurations have been used. These basic types include a "tile" array antenna and a "brick" array antenna. A tile configuration places the element electronics in a tile-like arrangement in the plane of the radiating aperture and mounted on a printed wiring board (PWB) containing the RF, DC, and control signal distribution networks. A brick configuration places the element electronics in an upright position located beneath the plane of the radiating aperture. The radiating elements, associated electronics, and supporting structure are typically divided into rows, as is illustrated in FIG. 1.

FIG. 1 illustrates an exploded view of a multiple-layer PWB 100 associated with a tile array antenna. PWB 100 includes a Wilkinson divider network 102, a plurality of amplifier modules 104, and a plurality of radiating elements 106 mounted in a tile array configuration on a surface 110 of PWB 100. Incoming signals 112 from beam driver amplifiers (not illustrated) are divided by Wilkinson divider network 102 into a number of signals that corresponds to the number of radiating elements 106. Each signal is then amplified by an amplifier module 104, which includes an SSPA. Each amplified signal is then provided to a radiating element 106, which produces an electromagnetic wave that travels generally in direction 114 (e.g., the bore-sight of the antenna). A multi-beam array contains a beam driver amplifier and Wilkinson divider network for every beam. The beams are then combined using a Wilkinson combiner network, and the composite signal is then provided to the amplifier module. In conventional tile array systems, amplifier modules 104 are oriented perpendicularly to the bore-sight of the antenna.

Although phased array systems having a tile array configuration may include fewer cables and connectors than their brick counterparts, tile array systems have several negative aspects. First, because amplifier modules 104 are oriented perpendicularly to the bore-sight of the antenna, the physical dimensions of the amplifier modules 104 are limited to the lattice spacing of the array (e.g., the distance between radiating elements 106). The lattice spacing of an array decreases as the frequency of operation increases, and accordingly, the physical dimensions of the amplifier modules 104 should become smaller as the frequency of operation increases. For example, a typical phased array system may have approximately $0.5\lambda$ lattice spacing in order to provide reasonable grating-lobe free performance, where $\lambda$ is the free-space wavelength of the RF signal. At higher operating frequencies (e.g., frequencies at or higher than Ku-band frequencies), the lattice spacing may be so small that an amplifier module having sufficiently small dimensions may not be readily manufacturable using current semiconductor manufacturing technologies.

In addition, a large number of layers (e.g., 28 or more) may be used to implement the Wilkinson combiner network 102, power lines, control lines, and radiating elements 106. Because numerous vias and transmission lines are present within the layers, a significant likelihood exists that one or more defective vias or transmission lines may be present within a newly manufactured PWB. Also, in the case of a transmission line or via failure, reworking the PWB may be difficult or impossible. Accordingly, manufacturing yields may be relatively low, particularly in PWBs that support large arrays (e.g., arrays with hundreds or thousands of radiating elements).

Another negative aspect of a tile array configuration relates to dissipating heat through the PWB layers. For some phased array systems, high power levels (e.g., 2-8 Watts (W)) may be required from each amplifier module (e.g., each SSPA). Because PWB materials generally are poor heat conductors, intolerable thermal gradients may be produced within the PWB layers proximate to the amplifier modules.

A brick array configuration for a phased array antenna system provides an alternative to a tile array configuration. A brick array configuration also includes a planar structure, upon which an array of radiating elements is positioned. An array of amplifier modules and a Wilkinson combiner network are located beneath the planar structure. However, the amplifier modules are arranged in parallel with the bore-sight of the antenna. Accordingly, a brick array configuration has an advantage over a tile array configuration in that the amplifier modules of the brick array configuration are not entirely limited by the lattice spacing of the radiating elements. Accordingly, a brick array configuration may be adapted to operate at higher frequencies than a tile array configuration.

However, a negative aspect of a brick array configuration is that it includes a large number of RF cable/connector types of interconnects. These interconnects are costly, difficult to assemble, and add a significant amount of weight to the system. Further, the connectors are susceptible to becoming dislodged in high-vibration situations (e.g., during launch of a spacecraft).

It is desirable to provide phased array systems, apparatus, and methods, which may be operated at relatively high frequencies, and which may have improved thermal performance, manufacturing yield, weight, reliability, and/or cost. Other desirable features and characteristics of embodiments of the inventive subject matter will become apparent from the subsequent detailed description and the appended claims, taken in conjunction with the accompanying drawings and the foregoing technical field and background.

BRIEF DESCRIPTION OF THE DRAWINGS

Various embodiments will hereinafter be described in conjunction with the following drawing figures, wherein like numerals denote like elements.

DETAILED DESCRIPTION

The following detailed description is merely exemplary in nature and is not intended to limit the described embodiments or the application and uses of the described embodiments. Furthermore, there is no intention to be bound by any expressed or implied theory presented in the preceding technical field or background, or in the following detailed description.

Embodiments of the inventive subject matter include phased array antenna apparatus, assemblies, and systems having one or more features that distinguish these apparatus, assemblies, and systems over conventional tile array and brick array configurations. Other embodiments include methods of transmitting and receiving signals using various phased array antenna systems. Still other embodiments include methods of manufacturing phased array antenna assemblies.

Figure 1:
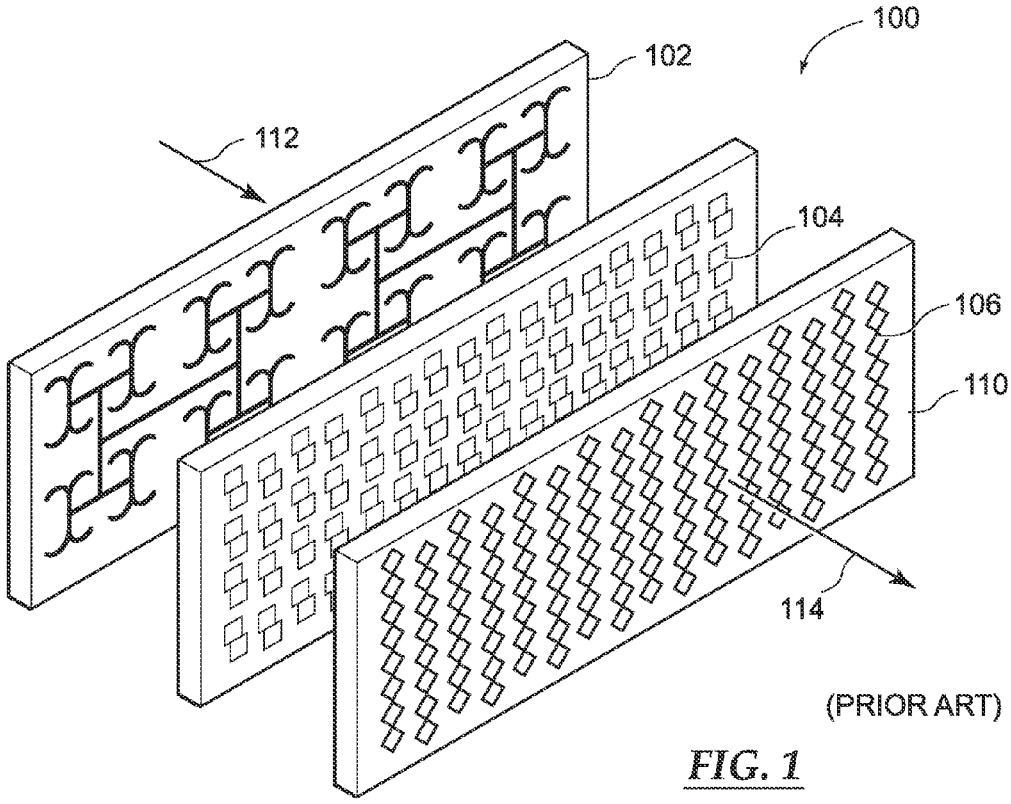
(PRIOR ART) FIG. 1
FIG. 1 illustrates an exploded view of a multiple-layer PWB associated with a tile array antenna.
Figure 2:
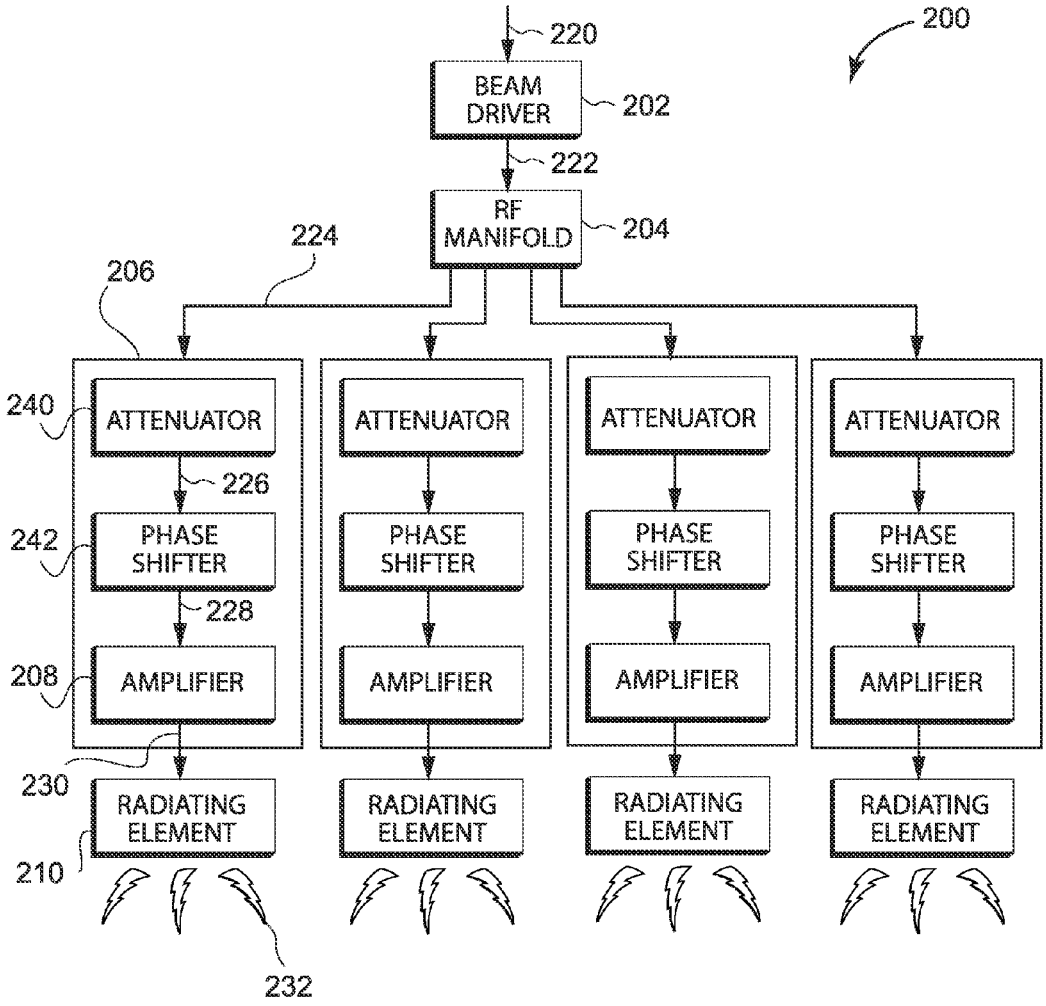
FIG. 2 illustrates a simplified, block diagram of a single-beam, transmit phased array antenna system, in accordance with an example embodiment of the inventive subject matter.

FIG. 2 illustrates a simplified, block diagram of a single-beam, transmit phased array antenna system 200, in accordance with an example embodiment of the inventive subject matter. In an embodiment, antenna system 200 includes a beam driver 202, an RF manifold 204, a plurality of RF electronics modules 206, and a plurality of radiating elements 208.

In the illustrated embodiment, system 200 includes four RF electronics modules 206 and four radiating elements 208. In other embodiments, a system may include more (e.g., tens, hundreds or thousands) RF electronics modules 206 and radiating elements 208. A simplified single-beam, four-element system is illustrated for ease of explanation.

Beam driver 202 receives an input RF signal 220 from another component (not illustrated) of a host system (e.g., a processor system on board a satellite). For example, an input RF signal 220 may include a multiplexed communication signal, which includes communication data for multiple intended recipients. Alternatively, input RF signals 220 may include other types of signals, including but not limited to radar signals, for example. Beam driver 202 pre-amplifies input RF signal 220 to produce an amplified input RF signal 222. Amplification of input RF signal 220 is performed to compensate for signal power reductions that occur when the signal is divided by RF manifold 204 and to provide sufficient signal level to drive amplifiers 208 to desired operating points.

RF manifold 204 functions as a passive RF power divider. Accordingly, RF manifold 204 receives and divides the amplified input RF signal 222 to produce multiple RF signals 224. In an embodiment, RF manifold 204 divides the amplified input RF signal 222 into $N_{ARRAY}$ RF signals 224, where $N_{ARRAY}$ equals the number of radiating elements 210, and each RF signal 224 corresponds to a beam path associated with a particular one of radiating elements 210. RF manifold 204 may include from one to multiple stages, where each stage may divide its input signals into multiple output signals. For example, for $N_{ARRAY}=500$, RF manifold 204 may include two stages, where a first stage performs a 1:5 signal division, and a second stage performs a 1:10 signal division. Accordingly, for a single input signal, the first stage would produce 5 output signals, and the second stage would produce 500 output signals. Each stage may have the same or a different ratio of input signals to output signals, in various embodiments. In an embodiment, the power of each RF signal 224 approximately equals $P/N_{ARRAY}-P_{LOSS}$, where P is the power of amplified input RF signal 222, and $P_{LOSS}$ is the conductive loss through RF manifold 204 for each beam path. Additionally, the RF power division may be non-uniform (e.g., unequal power levels at output ports).

RF electronics modules 206 receive the multiple RF signals 224. In an embodiment, each RF electronics module 206 includes an attenuator 240 and a phase shifter 242, which together may be considered to comprise a beamformer. In addition, in an embodiment, each RF electronics module 206 may include an amplifier 208. In an alternate embodiment, amplifier 208 may be included in a separate module.

Along each beam path, an attenuator 240 receives and applies a weighting to one of the RF signals 224 to produce an attenuated RF signal 226, in an embodiment. In an alternate embodiment, RF signals 224 are not attenuated, and attenuator 240 may be excluded from system 200. A phase shifter 242 receives and applies a phase shift to the attenuated RF signals 226 (or to one of the RF signals 224, if an attenuator is excluded) to produce a phase-shifted RF signal 228. In another embodiment, the signals may be attenuated after being phase shifted (e.g., attenuator 240 and phase shifter 242 may occur in reverse order). Amplifiers 208 receive and amplify the phase-shifted RF signals 228 to produce amplified RF signals 230. In an embodiment, along each beam path, each amplifier 208 includes at least one SSPA.

Each radiating element 210 receives and radiates an amplified RF signal 230 to produce an output signal 232, which is radiated onto the air interface. In an embodiment, a radiating element 210 is present for each amplified RF signal 230 (e.g., for each beam path). Radiating elements 210 may be configured to produce output signals 232 that are singularly-polarized or that are dual-polarized, in various embodiments.

The description of FIG. 2, above, describes signal processing for a transmit antenna system 200. A receive phased array antenna system (not illustrated) has similarities to the transmit phased array antenna system 200 illustrated in FIG. 2, and embodiments of received antennas are included within the scope of the inventive subject matter. Signal processing for a receive antenna system will now be described briefly.

For a receive antenna system, each radiating element (e.g., a counterpart to radiating element 210) receives a wireless analog signal from the air interface, and produces an RF input signal. An amplifier (e.g., a counterpart to amplifiers 208) receives and amplifies the RF input signal to produce an amplified RF signal. A phase shifter (e.g., a counterpart to phase shifter 242) receives and applies a phase shift to the amplified RF signal. An attenuator (e.g., a counterpart to attenuator 240) may then apply a weighting to the phase shifted RF signal to produce an attenuated RF signal. An attenuator alternatively may be excluded.

For a receive antenna system, an RF manifold (e.g., a counterpart to RF manifold 204) functions as a passive RF power combiner. Accordingly, an RF manifold receives and combines the phase shifted RF signals to produce an RF manifold output signal. As described previously, an RF manifold may include from one to multiple stages. For a receive antenna, each stage may combine multiple input signals into a smaller number of output signals, until a final stage produces a single output signal.

A beam driver is not included in a receive antenna system. Instead, a receive antenna system may include a low-noise amplifier (LNA) (not illustrated), which receives the RF manifold output signal. The LNA may amplify the RF manifold output signal to produce an LNA output signal. Alternatively, a receive antenna system may not include an LNA. The receive antenna system's output signal may be further processed or manipulated by other components (not illustrated) of the host system.

Figure 3:
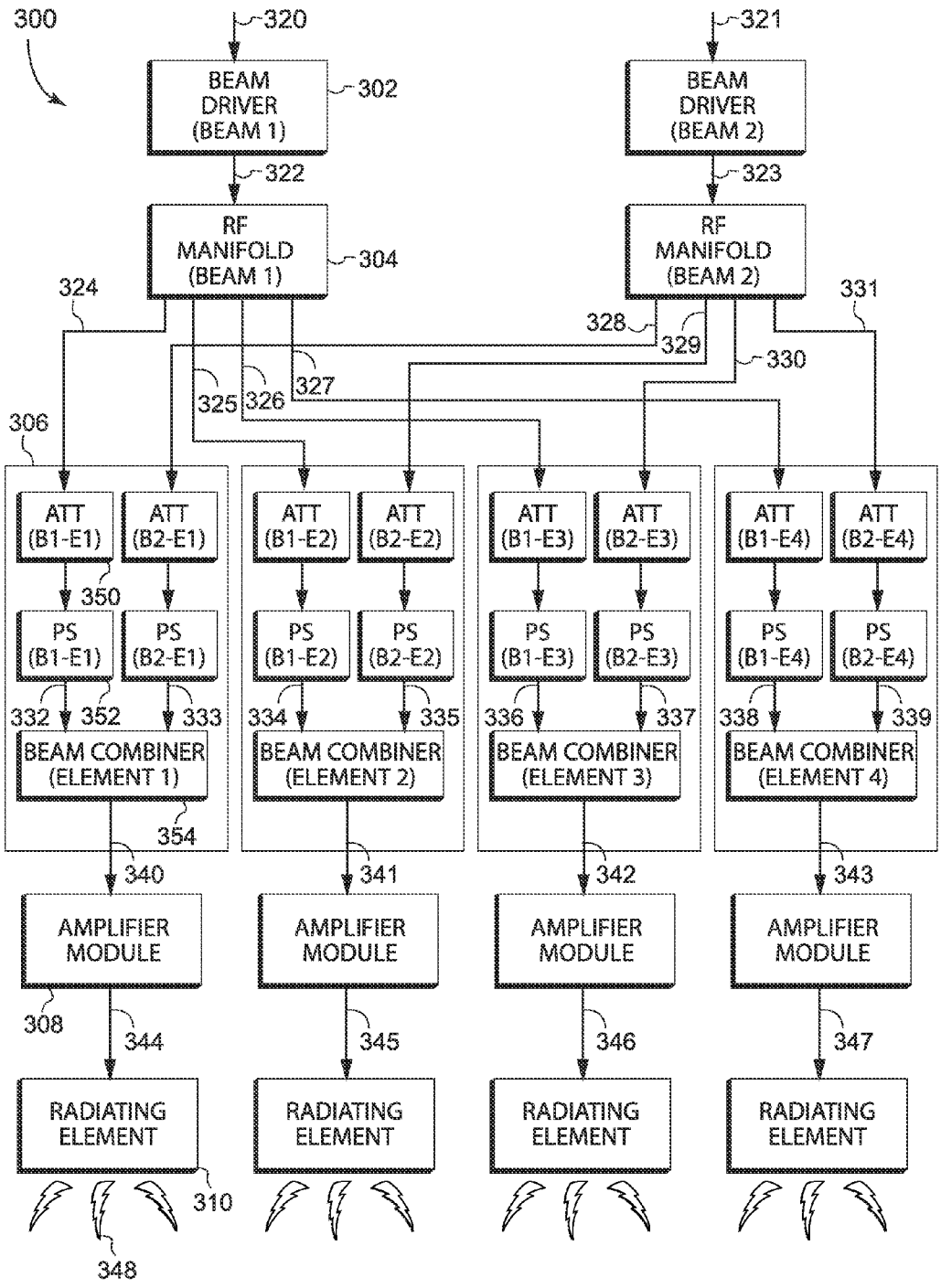
FIG. 3 illustrates a simplified, block diagram of a two-beam, transmit phased array antenna system, in accordance with an example embodiment.

FIG. 3 illustrates a simplified, block diagram of a two-beam, transmit phased array antenna system 300, in accordance with an example embodiment. Antenna system 300 includes a beam driver 302 and RF manifold 304 for each beam, in an embodiment. Further, antenna system 300 includes a beamformer module 306 and an amplifier module 308 for each radiating element 310, in an embodiment. In particular, antenna system 300 includes $N_{BEAM}$ of beam drivers 302 and RF manifolds 304, where $N_{BEAM}$ is the number of beams provided by antenna system 300. Antenna system 300 also includes $N_{ELEMENT}$ of beamformer modules 306 and amplifier modules 308, where $N_{ELEMENT}$ is the number of radiating elements 310 included in antenna system 300.

In the illustrated embodiment, system 300 includes two beam drivers 302 and RF manifolds 304. In other embodiments, a multiple-beam system may include more beam drivers 302 and RF manifolds 304. In other words, a multiple-beam, phased array antenna system may provide from two to many beams (e.g., from 2 to 64 or more). The number of beams provided may be a factor of two (e.g., $2^n$), or may be some other number. The illustrated system also is shown to include four beamformer modules 306, amplifier modules 308, and radiating elements 310. In other embodiments, a system may include more (e.g., tens, hundreds or thousands) beamformer modules 306, amplifier modules 308, and radiating elements 310. A simplified, two-beam, four-element system is illustrated for ease of explanation.

In a transmit mode, beam drivers 302 receive input RF signals 320, 321 from one or more other components (not illustrated) of a host system (e.g., processor systems on board a satellite). For example, an input RF signal (e.g., signal 320) may include a multiplexed communication signal, which includes communication data for multiple intended recipients. Alternatively, input RF signals 320, 321 may include other types of signals, including but not limited to radar signals, for example. Beam drivers 302 pre-amplify input RF signals 320, 321 to produce amplified input RF signals 322, 323. Amplification of input RF signals 320, 321 is performed to compensate for signal power reductions that occur when the signals are divided by RF manifolds 304 and to provide sufficient signal level to drive the power amplifier to the desired operating point.

RF manifolds 304 function as passive RF power dividers, while operating in transmit mode. Accordingly, RF manifolds 304 receive and divide the amplified input RF signals 322, 323 to produce multiple sets of RF signals 324, 325, 326, 327, 328, 329, 330, 331. In an embodiment, each RF manifold 304 divides its respective amplified input RF signal 322, 323 into $N_{ARRAY}$ RF signals 324-331, where $N_{ARRAY}$ equals the number of radiating elements 310. Accordingly, for example, when $N_{ARRAY}=4$ and $N_{BEAM}=2$, each RF manifold 304 may produce four RF signals, resulting in a total of eight RF signals 324-331. Each RF manifold 304 may include from one to multiple stages, where each stage may divide its input signals into multiple output signals.

Beamformer modules 306 receive the RF signals 324-331 output from RF manifolds 304. As mentioned previously, system 300 includes $N_{ELEMENT}$ beamformer modules 306. In an embodiment, each beamformer module 306 includes $N_{BEAM}$ attenuators 350 ("ATT"), $N_{BEAM}$ phase shifters 352 ("PS"), and a beam combiner 354. The attenuators 350 and phase shifters 352 for each beam/element combination are indicated in parenthesis in blocks 350 and 352. For example, "ATT (B1-E1)" indicates an attenuator 350 along a path associated with beam 1 and element 1.

As described previously, each attenuator 350 and phase shifter 352 may attenuate and phase shift, respectively, one of input RF signals 324-331, to produce RF signals 332, 333, 334, 335, 336, 337, 338, 339. Ultimately, the signals will be distinctly receivable at the far field of the antenna based on the phase weights applied by phase shifters 352.

Each beam combiner 354 combines $N_{BEAM}$ of RF signals 332-339, to produce $N_{ELEMENT}$ composite RF signals 340, 341, 342, 343. In receive mode, beam combiner 354 acts as a beam divider, and accordingly this component may be referred to more generally as a beam combiner/divider. In an embodiment, the beam combiners 354 produce a total of $N_{ARRAY}$ composite RF signals 340-343. Amplifiers within amplifier modules 310 are operably connected to beamformer modules 306. These amplifiers receive and amplify the composite RF signals 340-343 to produce amplified, composite RF signals 344, 345, 346, 347. Radiating elements 310, which are operably connected to the amplifiers, then radiate signals 348 onto the air interface. In various embodiments, as will be described later, substantially all or portions of RF manifolds 304, beamformer modules 306, amplifier modules 308, and radiating elements 310 may be embedded within or attached to a PWB assembly. In addition, some of the interconnections between these various modules may be embedded within a PWB assembly.

The description of FIG. 3, above, describes signal processing for a multiple-beam, transmit antenna system 300. A multiple-beam, receive phased array antenna system (not illustrated) has similarities to the multiple-beam transmit phased array antenna system 300 illustrated in FIG. 3, and embodiments of receive antennas are included within the scope of the inventive subject matter. Unlike a transmit antenna system (e.g., system 300), a multiple-beam receive phased array antenna system does not include beam drivers (e.g., beam drivers 302, FIG. 3), but instead may include a low noise amplifier (LNA), as described previously in conjunction with the description of FIG. 2. Further, a multiple-beam phased array antenna system includes a beam divider for each element, rather than a beam combiner (e.g., beam combiners 354, FIG. 3). Signal processing for a single-beam, receive antenna system was described previously in conjunction with FIG. 2. That description may be extrapolated to describe signal processing for a multiple-beam, receive antenna system. However, for purposes of brevity, that description is not included herein.

The description associated with FIGS. 2 and 3 pertain to a singularly-polarized array. It is to be understood that embodiments also include dual-polarized arrays. In a dual-polarized array, a single radiating element may simultaneously radiate (or receive) two independent, orthogonal signals. The systems illustrated and described in conjunction with FIGS. 2 and 3 may be modified to include two beam drivers and RF manifolds for each polarization and for each beam. In addition, the systems illustrated and described in conjunction with FIGS. 2 and 3 may be modified to include two beamformer modules and two amplifier modules for each dual-polarized radiating element. Embodiments of dual-polarized arrays are not described in detail herein.

Figure 4:
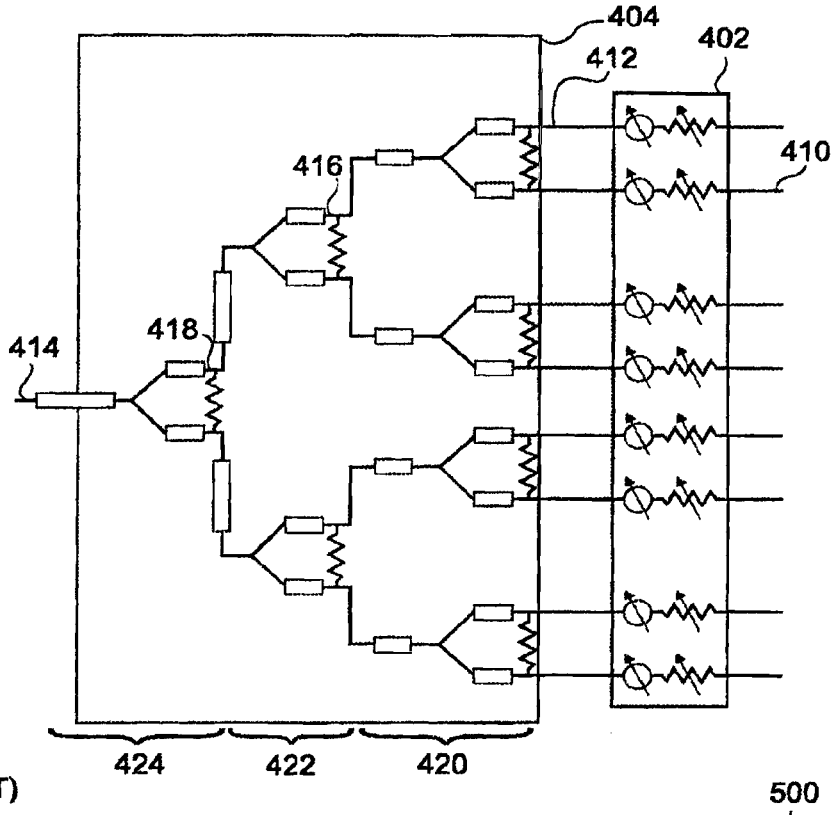
FIG. 4 (PRIOR ART)
FIG. 4 illustrates a schematic of a set of attenuators/phase shifters and a beam combiner for a conventional eight-beam, transmit phased array antenna system.
Figure 5:
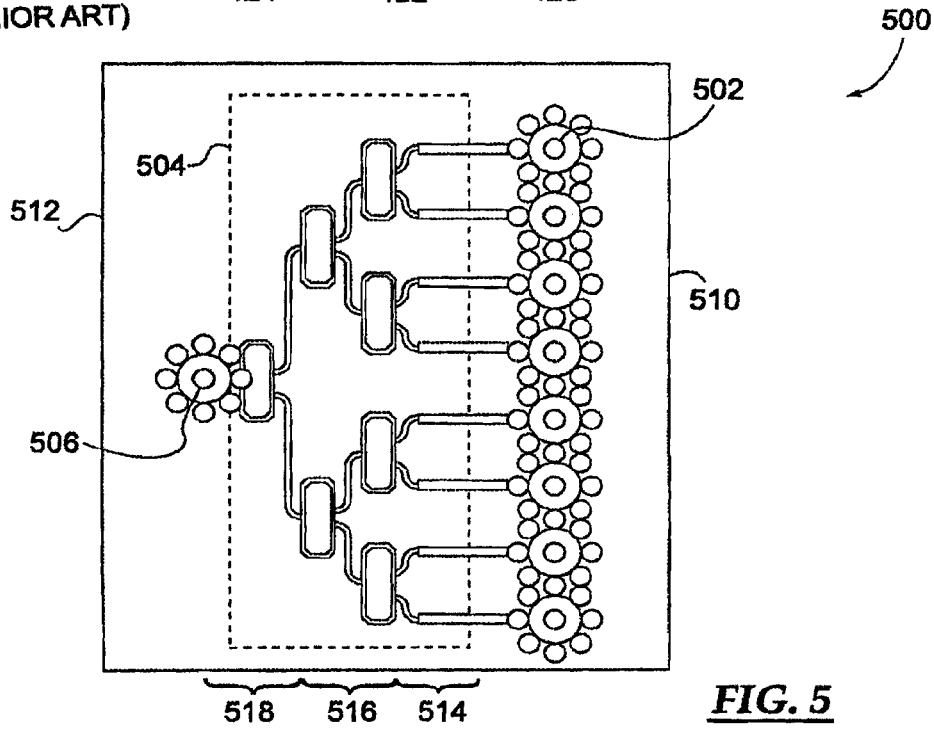
FIG. 5 (PRIOR ART)
FIG. 5 illustrates a layout of a beam combiner network of a conventional transmit phased array antenna system.

In conjunction with FIGS. 4-9, various schematics, layouts, and panel assemblies for multiple-beam, phased array antenna systems are described in order to indicate distinguishing features relating to beamformer modules, RF manifolds, and orientations of various system modules and components for conventional systems and for systems that implement embodiments of the inventive subject matter. FIGS. 4 and 5 correspond to multiple-beam phased array antenna systems that employ conventional technologies, and FIGS. 6 and 7 correspond to multiple-beam phased array antenna systems of various embodiments.

For purposes of brevity, the modules and systems illustrated FIGS. 4-9 will be described as if they are being operated in a transmit mode. Operation in a receive mode is not described in detail herein. Embodiments of the inventive subject matter are intended to include embodiments relating to antenna operation in either transmit mode or receive mode.

FIG. 4 illustrates a schematic of a set of attenuators/phase shifters 402 and a beam combiner 404 for a conventional eight-beam, transmit phased array antenna system. The attenuators/phase shifters 402 and the beam combiner 404 may be part of a single beamformer module. Attenuators/phase shifters 402 receive, attenuate, and apply phase shifts to input signals 410, where each applied phase shift corresponds to a phase weighting for a different beam. Beam combiner 404 receives the phase-shifted output signals 412, and combines the signals to produce a composite RF signal 414.

A conventional beam combiner 404 includes an 8-way combiner network having three tiers 420, 422, 424. In a transmit mode, the first tier 420 includes four conventional 2-way Wilkinson combiner networks, each of which combines a pair of the eight input signals 412 to produce four first-tier output signals 416. A Wilkinson combiner network includes two input ports and an output port. In addition, a Wilkinson combiner network includes multiple quarter-wave transformers and isolation resistors.

The second tier 422 of the 8-way combiner includes two conventional 2-way Wilkinson combiner networks, each of which combines a pair of the four first-tier output signals 416 to produce two second-tier output signals 418. The third tier 424 includes one conventional 2-way Wilkinson combiner network which combines the second-tier output signals 418 to produce the composite RF signal 414. The output signal 414 may then be amplified before it is provided to a radiating element.

FIG. 5 illustrates a layout 500 of a beam combiner of a conventional, transmit phased array antenna system. For example, layout 500 may be a layout for beam combiner 404 (FIG. 4). Layout 500 includes input connectors 502, a combiner network 504, and an output connector 506. Input connectors 502 and output connector 506 are "virtual" coaxial connectors, each of which includes multiple ground vias surrounding a single RF signal via. As FIG. 5 illustrates, all input connectors 502 are positioned proximate to one side 510 of combiner network 504, and output connector 506 is positioned proximate to another (e.g., an opposite) side 512 of combiner network 504.

Combiner network 504 receives multiple phase shifted input signals through input connectors 502, and combines the RF input signals into a composite RF output signal. The composite RF output signal is provided through output connector 506. Combiner network 504 includes an 8-way combiner network, which is implemented using three tiers 514, 516, 518 of conventional Wilkinson combiner networks, as described in conjunction with FIG. 4. In conventional systems, an m-way ($m=2^n$) combiner network will include n tiers, where each tier combines signal pairs to produce half as many output signals as input signals.

In a conventional, multiple-tier combiner that uses Wilkinson combiners, the total length of the conductive path increases between the input and outputs of the combiner as the number of tiers increases. Accordingly, the insertion loss (e.g., the metal conductive loss) also increases. To achieve output RF signals at a desired power level, a system should provide input RF signals having sufficient power to compensate for the insertion loss inherent in a conventional multiple-tier combiner with multiple Wilkinson combiner stages. It is desirable to minimize such losses in a power-restricted system, such as a satellite or other battery driven system, for example.

Embodiments of the inventive subject matter provide an m-way beam combiner that may have significantly lower insertion losses than beam combiners that implement conventional multiple-tier combiners. As will be explained in conjunction with FIGS. 6 and 7, embodiments of the inventive subject matter include beam combiners having an "H form" configuration that may reduce the overall distance between input RF signals and an output RF signal.

Figure 6:
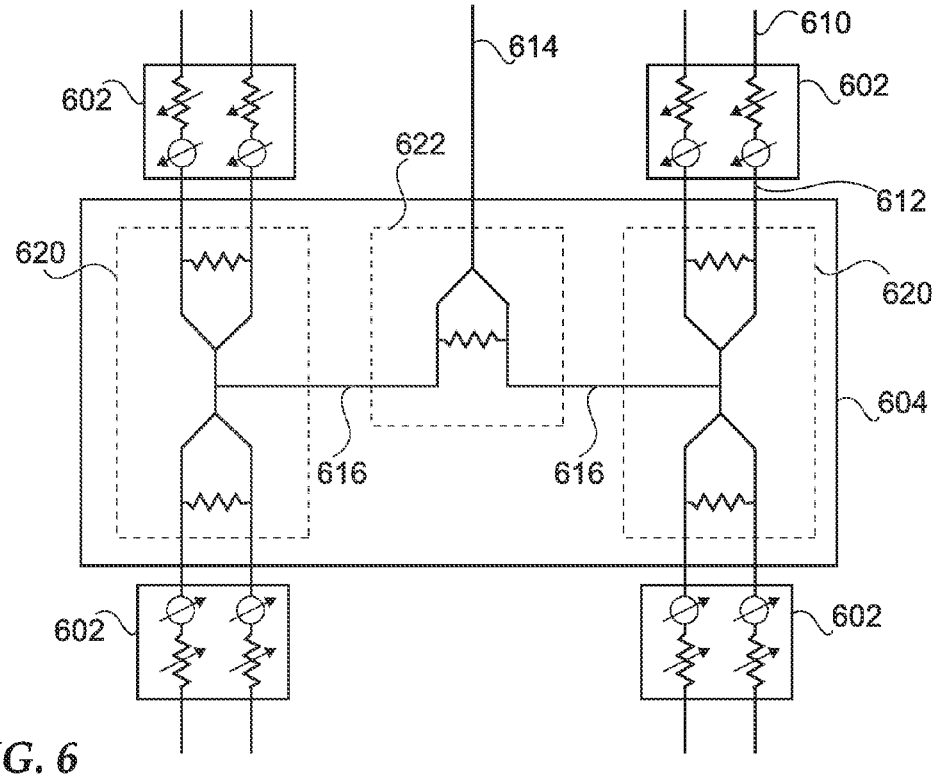
FIG. 6 illustrates a schematic of sets of attenuators/phase shifters and a beam combiner of an eight-beam, transmit phased array antenna system, in accordance with an example embodiment.

FIG. 6 illustrates a schematic of sets of attenuators/phase shifters 602 and a beam combiner 604 of an eight-beam, transmit phased array antenna system, in accordance with an example embodiment. The attenuators/phase shifters 602 and the beam combiner 604 may be part of a single beamformer module (e.g., module 306, FIG. 3). For purposes of brevity, attenuators/phase shifters 602 and beam combiner 604 will be described as if they are being operated in a transmit mode. Accordingly, beam combiner 604 will be described as combining a multiple, phase-shifted RF signals to produce a single, composite RF output signal. It is to be understood that, in a receive mode, beam combiner 604 may alternatively function as a beam divider, which divides a single, composite RF signal into multiple output RF signals. However, operation in a receive mode is not described in detail herein.

Attenuators/phase shifters 602 receive, attenuate, and apply phase shifts to input signals 610, where each applied phase shift corresponds to a phase weighting for a different beam. Beam combiner 604 receives the phase-shifted output signals 612, and combines the signals to produce a composite RF signal 614.

In accordance with an embodiment, beam combiner 604 includes an 8-way combiner network having two tiers 620, 622. In a transmit mode, the first tier 620 includes a 4-way combiner network, which combines pairs of the eight input signals 612 to produce two first-tier output signals 616. The second tier 622 of the 8-way combiner network includes a 2-way Wilkinson combiner network, which combines the two first-tier output signals 616 to produce a composite, second-tier output signal 614. The output signal 614 may then be amplified (e.g., by amplifier module 308, FIG. 3) before it is provided to a radiating element (e.g., radiating element 310, FIG. 3). Beam combiner 604 is referred to herein as an "H form" combiner, because the orientation of the inputs, transmission lines, and output have roughly an H shape, as is illustrated in FIGS. 6 and 7.

Figure 7:
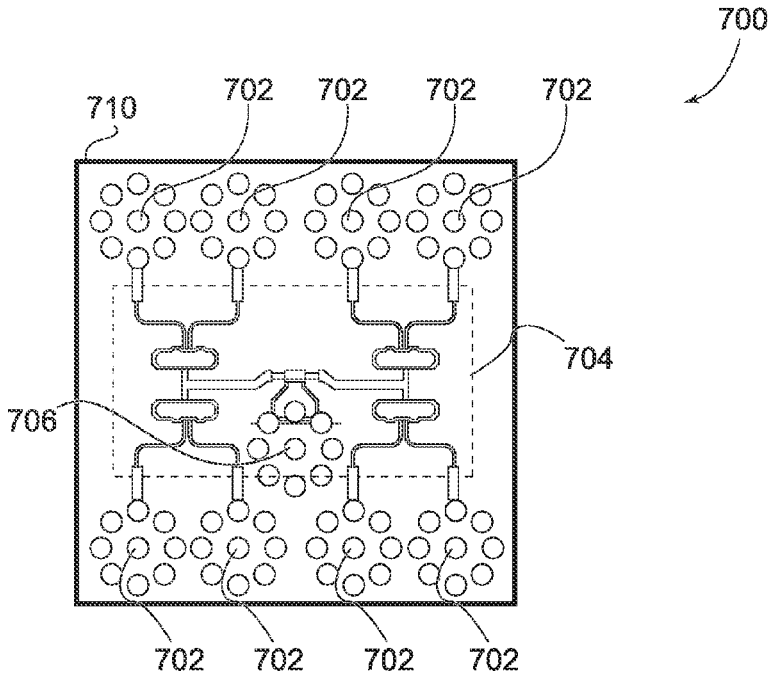
FIG. 7 illustrates a layout of an H form combiner, in accordance with an example embodiment.

FIG. 7 illustrates a layout 700 of an H form beam combiner, in accordance with an example embodiment. For example, layout 700 may be a layout for beam combiner 604 (FIG. 6). As with the description of FIG. 6, layout 700 will be described as if the combiner is being operated in transmit mode, for purposes of brevity. Layout 700 includes input connectors 702 (or ports), a combiner network 704, and an output connector 706 (or port). Input connectors 702 and output connector 706 may include virtual coaxial connectors, in an embodiment, each of which includes multiple ground vias surrounding a single RF signal via. In a particular embodiment, input connectors 702 and output connector 706 may include virtual coaxial connectors that may be snapped onto other antenna components or substrates.

Beam combiner 704 receives multiple RF input signals through input connectors 702, and combines the RF input signals into a single, composite RF output signal. The composite RF output signal is provided through output connector 706. Beam combiner 704 includes an H form, 8-way combiner network, which is implemented using two tiers, in an embodiment. In other embodiments, a beam combiner may combine more than eight RF input signals into a composite RF output signal.

In an embodiment, a first tier includes quarter-wave impedance transformers, each with a line impedance of about 0.7071Zo. The transformers transform the signal impedances to about 0.5 Zo at the output of each transformer line, and each output is then combined in the second tier. The second tier includes two, 2-way Wilkinson combiners, each with a termination impedance of about Zo. Because an 8-way combiner network of an embodiment includes two tiers, rather than three, and thus does not include the transmission lines associated with a third tier, the length of the conductive path between an input and an output may be substantially shorter than the length of the conductive path for a conventional 8-way Wilkinson combiner network. Accordingly, using an embodiment of the inventive subject matter, the insertion loss though the beam combiner 702 may be significantly less than the insertion loss for a conventional Wilkinson combiner network. Embodiments of an H form beam combiner may apply to many 2'-way combiner networks. In these alternate embodiments, all, some or as few as one tier (e.g., the tier connected to the input connectors) may have an H form.

Various distinctions are apparent when comparing the beam combiner 704 of FIG. 7 with the beam combiner 504 of FIG. 5. For example, the beam combiner 704 of FIG. 7 includes an output connector 706 that is positioned proximate to a central part of the beam combiner 704 (e.g., proximate to the center of the horizontal member of the H form), rather than being positioned proximate to one side 512 of the beam combiner 504 of FIG. 5. Further, input connectors 702 of the beam combiner 704 of FIG. 7 are positioned proximate to multiple sides 710, 712 of beam combiner 704 (e.g., proximate to the top and bottom sides of the H form), rather than being positioned proximate to a single, opposite side 510 of the beam combiner 504 of FIG. 5 from the output connector 502.

In an embodiment, this distinction yields a beam combiner 704 that may have significantly shorter conductive paths between input connectors 702 and output connector 706, as compared with the length of the conductive paths between input connectors 502 and output connector 506 of the beam combiner 504 of FIG. 5. Accordingly, embodiments of the inventive subject matter may include a beam combiner (e.g., beam combiner 704, FIG. 7) that has lower insertion losses than a conventional beam combiner (e.g., beam combiner 504, FIG. 5). This may provide an advantage of reducing DC power consumed by embodiments of the inventive subject matter.

As discussed previously in conjunction with FIG. 3, a multiple-beam, phased array antenna system may include $N_{ELEMENT}$ beamformer modules (e.g., beamformer modules 306, FIG. 3) connected to $N_{BEAM}$ RF manifolds (e.g., RF manifolds 304, FIG. 3). RF manifolds take a significant number of PWB layers to implement, in conventional systems. The arrangement of inputs and outputs for an H form, beam combiner (or beam divider, for a receive array), in accordance with various embodiments, enable interconnections RF manifolds to be implemented using significantly fewer PWB layers. RF manifolds for a multiple-beam phased array antenna system with a conventional beamformer module and a multiple-beam phased array antenna system according to various embodiments are illustrated and described in conjunction with FIGS. 8 and 9, respectively.

Figure 8:
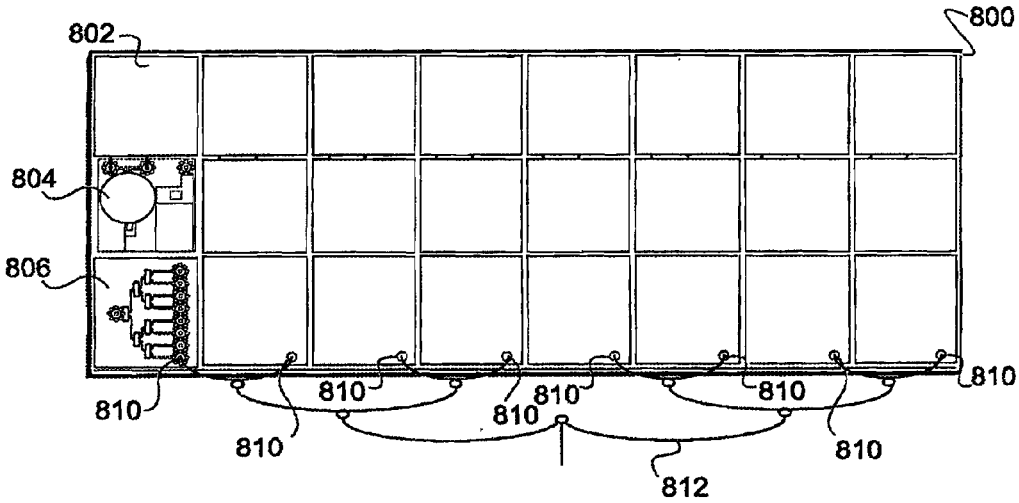
FIG. 8 (PRIOR ART)
FIG. 8 illustrates a row panel and interconnects between an RF manifold and conventional beamformer modules for an eight-beam, eight-element, transmit phased array antenna system.

FIG. 8 illustrates a row panel 800 an RF manifold 812 for an eight-beam, eight-element, transmit phased array antenna system. In particular, FIG. 8 illustrates a row panel 800, which includes eight radiating elements 802, eight amplifier modules 804, and eight beamformer modules 806. A set of corresponding inputs 810 (or ports) of the beamformer modules 806 are interconnected with strip-line RF manifold 812 disposed on layers of a multiple-layer PWB. Using conventional technologies, an RF manifold 812 for a single set of corresponding inputs is implemented using two PWB layers. Although not illustrated for purposes of clarity, similarly configured RF manifolds also are included for the other seven sets of corresponding inputs (e.g., for the other seven beams). Because of the physical configuration of the sets of corresponding inputs, the RF manifold for each set of corresponding inputs uses two separate and distinct PWB layers, in order to avoid cross-overs of the RF transmission lines within the layers. Accordingly, for an eight-beam phased array antenna system, the RF manifolds includes at least sixteen PWB layers to implement.

In addition, approximately 4-6 layers may be used to carry the DC voltage, control data, and clock lines. Accordingly, approximately 20-22 layers are used for the row panel interconnects. Because the loss of the virtual coaxial interconnects may be high through so many layers, the level of signal amplification should be sufficiently high to recover the strip-line loss of the interconnect wiring and to maintain a reasonably low system noise figure. Higher amplification increases the DC power consumption, and contributes to the heat dissipation issues present in phased array antenna systems that use conventional beamformer modules.

Figure 9:
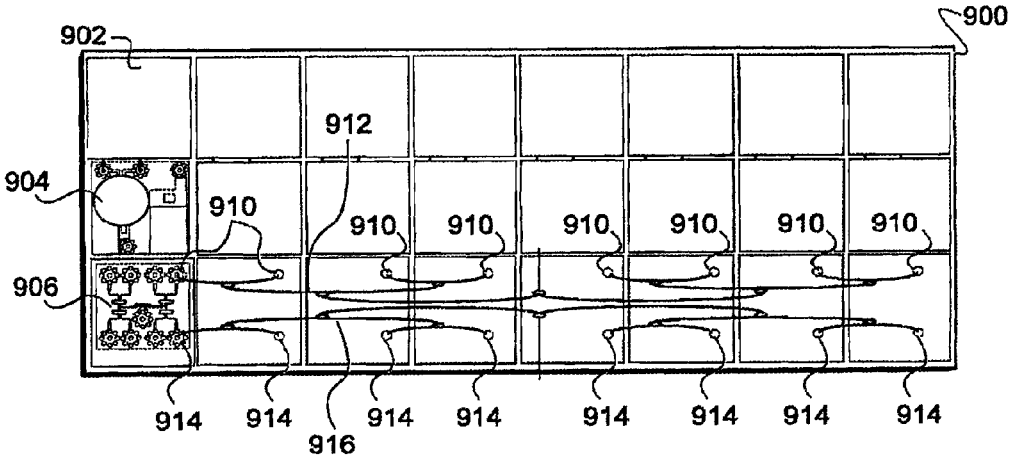
FIG. 9 illustrates a row panel and interconnects between an RF manifold and beamformer modules for an eight-beam, eight-element, transmit phased array antenna system.

FIG. 9 illustrates a row panel 900 and RF manifolds 912, 916 for an eight-beam, eight-element, transmit phased array antenna system, in accordance with an example embodiment. In particular, FIG. 9 illustrates a row panel 900, which includes a plurality of radiating elements 902, a plurality of amplifier modules 904, and a plurality of beamformer modules 906. Although row panel 900 includes eight each of radiating elements 902, amplifier modules 904, and beamformer modules 906, the row panel size can be any integer number of $N_{ELEMENT}$, in various embodiments.

A first set of corresponding inputs 910 (or ports) of the beamformer modules 906 are interconnected with a first strip-line RF manifold 912 disposed on layers of a multiple-layer PWB. RF manifold 912 represents interconnections between a first set of corresponding ports of the plurality of beamformer modules 906. In addition, a second set of corresponding inputs 914 are interconnected with a second strip-line RF manifold 916. RF manifold 916 represents interconnections between a second set of corresponding ports of the plurality of beamformer modules 906. Although not illustrated for purposes of clarity, similarly configured interconnect wiring also is included for the other six sets of corresponding inputs (e.g., for the other six beams). Because of the physical configuration of the sets of corresponding inputs, in accordance with various embodiments, the second set of corresponding inputs 914 of the beamformer modules 906 may be interconnected with RF manifolds 916 disposed on the same layers of the PWB as RF manifold 912 for the first set of corresponding inputs 910, without producing cross-overs between RF manifolds 912 and 916. Accordingly, for an eight-beam phased array antenna system, the RF manifolds 912 and 916 may include as few as eight PWB layers, as opposed to the sixteen layers used in conjunction with conventional beamformer modules (e.g., modules 806, FIG. 8).

Because fewer layers may be used to implement the RF manifolds, the loss of the virtual coaxial interconnects may be significantly lower than the loss encountered using conventional beamformer modules. Accordingly, using embodiments of the inventive subject matter, the level of signal amplification may be lower, thus reducing the DC power consumption and heat production.

As described above, embodiments of the inventive subject matter may include beam combiners and RF manifolds that are configured differently from those associated with conventional phased array antenna systems. Embodiments may also or alternatively include other distinguishing features, including radiating elements that are integrally connected with a PWB substrate. Embodiments may also or alternatively include other features that provide excellent thermal paths between heat-producing elements (e.g., SSPAs) and heat dissipation apparatus. Other distinguishing features and/or combinations of features may be present in various embodiments. These distinguishing features will be described in detail, below.

Figure 10:
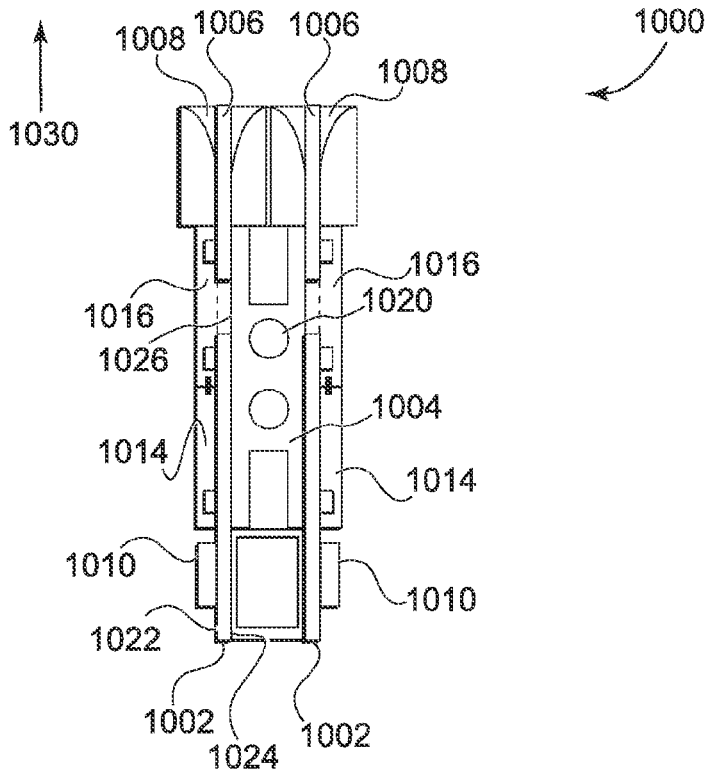
FIG. 10 illustrates a side view of a phased array antenna assembly, in accordance with an example embodiment.
Figure 11:
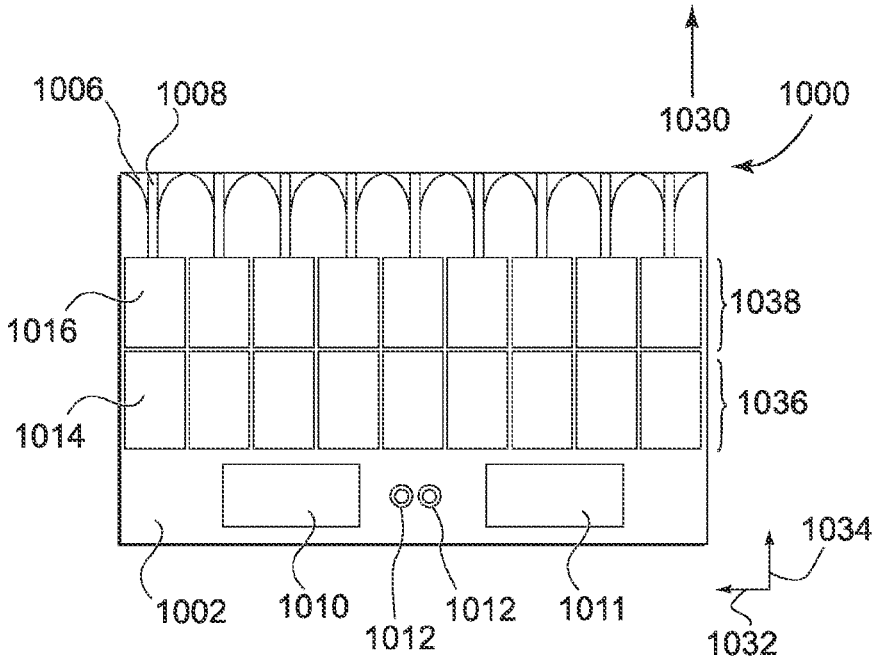
FIG. 11 illustrates a front view of a phased array antenna assembly, in accordance with an example embodiment.

FIG. 10 illustrates a side view of a phased array antenna assembly 1000, and FIG. 11 illustrates a front view of a phased array antenna assembly 1000, in accordance with an example embodiment. A complete antenna system may include multiple ones of assemblies 1000. Referring to FIGS. 10 and 11 simultaneously, assembly 1000 includes two multiple-layer PWBs 1002 and a heat sink 1004, in an embodiment. Each PWB 1002 includes a plurality of integral radiating elements 1006, to which orthogonal radiating elements 1008 are connected, in an embodiment. Orthogonal radiating elements 1008 arranged orthogonally to integral radiating elements 1006, and are connected to PWB 1002. In addition, at least one control electronics module 1010, power control module 1011, input/output RF connector 1012, beamformer module 1014, and amplifier module 1016 are connected to each PWB 1002, in an embodiment.

A first PWB 1002 is shown to be connected to a first side of heat sink 1004, and a second PWB 1002 is shown to be connected to a second side of heat sink 1004. Heat sink 1004 may include at least one channel 1020, in an embodiment, through which liquid or gaseous coolant may flow. For example, heat sink 1004 may include a dual-bore heat sink having two channels 1020. Channels 1020 may be configured to allow ammonia or some other coolant to flow through them, to facilitate drawing heat away from PWB 1002 and the various electronics connected to PWB 1002.

PWB 102 may include, for example, multiple laminated dielectric layers (e.g., organic substrates) upon with strip-line conductors are formed, and through which vias are formed. Substantially all or a portion of the RF manifolds (e.g., RF manifolds 304, FIG. 3) may be embedded within PWB 102, in an embodiment. This provides an advantage, over conventional systems, of eliminating the need for cables and connectors to carry RF signals to the beamformer modules. In addition, in an embodiment, integral radiating elements 1006, control lines (not illustrated), and DC lines (not illustrated) may be integrated into a single PWB 1002. In various embodiments, as described previously, the beamformer modules and the radiating elements 1006 are configured so that fewer PWB layers may be used to implement the RF manifolds and the radiating elements, than are used within conventional networks. For example, one layer may be used to implement strip-line interconnects for each pair of RF manifolds, and 4-6 layers may be used to route DC lines and control lines. Integral radiating elements 1006 may be implemented on one or more of the RF manifold, DC line, or control line layers, because the radiating elements 1006 are located in a separate area of the PWB. Using the above example, a PWB for an eight-beam phased array antenna assembly may include about 12-16 layers, in accordance with various embodiments, as compared with 20-22 layers for a conventional phased array antenna assembly.

An advantage to having fewer PWB layers is that the vertical coaxial interconnect losses may be significantly lower than the losses experienced using conventional phased array antenna assemblies that include more PWB layers. In addition, PWB manufacturing yields may be higher, because the smaller numbers of layers and the reduced via heights carry a reduced likelihood for PWB failure. Accordingly, embodiments of the inventive subject matter may have one or more advantages over conventional systems, in that embodiments may be less expensive and more reliable, and may weigh less than corresponding assemblies for conventional systems, in addition to being less complicated to manufacture.

PWB 1002 includes an electronics mounting surface 1022 and a heat sink attachment surface 1024. The heat sink attachment surface 1024 is connected to heat sink 1004, and beamformer module 1014 and amplifier module 1016 are attached to electronics mounting surface 1022. In an embodiment, beamformer module 1014 and amplifier module 1016 are connected with PWB 1002 using virtual coaxial connectors (e.g., connectors 702, 706, FIG. 7), which may include spring-loaded contacts (e.g., "fuzz buttons"). In alternate embodiments, some or all components of beamformer module 1014 and amplifier module 1016 may be mounted directly to PWB 1002, rather than being included in a discrete module.

PWB 1002 includes an opening 1026 positioned proximate to amplifier module 1016, and which extends between electronics mounting surface 1022 and heat sink attachment surface 1024, in an embodiment. Opening 1026 is adapted to enable an amplifier to directly contact heat sink 1004. An SSPA (not illustrated) and/or another portion of amplifier module 1016, when assembled with PWB 1002, extends through opening 1026 and directly contacts heat sink 1004, in an embodiment. Accordingly, heat generated by the SSPA may be transferred directly to heat sink 1004, rather than being transferred through layers of a PWB, as occurs in conventional phased array antenna systems. Direct amplifier module contact and direct heat transfer from an SSPA to a heat sink, in accordance with an embodiment, may result in significant improvements in the heat dissipation characteristics of assembly 1000 over conventional systems.

Integral radiating elements 1006 are formed within and/or on the surface of one or more layers of PWB 1002. Integral radiating elements 1006 are located proximate to an edge of PWB 1002, and oriented in parallel to a bore-sight of the phased array antenna apparatus. In an embodiment, integral radiating elements 1006 are arranged side-by-side along a top portion of PWB 1002.

In an embodiment, as few as two PWB layers may be used to implement integral radiating elements 1006. Integral radiating elements 1006 may include end-launch radiating elements, which may be etched onto a surface of PWB 1002, in an embodiment. Orthogonal radiating elements 1008 also may include end-launch radiating elements, which may be etched onto the surface of another substrate. The orthogonal element substrates are attached to PWB 1002 using mechanical and electrical connections (not illustrated). Integral radiating elements 1006 and orthogonal radiating elements 1008 enable assembly 1000 to transmit first signals having a first polarization simultaneously with transmitting second signals having a second polarization. In an embodiment, integral radiating elements 1006 and orthogonal radiating elements 1008 are planar radiating elements. Integral radiating elements 1006 and orthogonal radiating elements 1008 are oriented in the same direction as the bore-sight of assembly 1000, which is generally in a direction indicated by arrow 1030.

PWB 1002 has a substantially planar structure having length and width dimensions defined along a first axial direction 1032 and a second axial direction 1034, respectively. Beamformer module 1014 and amplifier module 1016 also have substantially planar structures having length and width dimensions defined along the first and second axial directions 1032, 1034. As FIGS. 10 and 11 illustrate, beamformer modules 1014 and amplifier modules 1016 are connected so that their width dimensions 1036, 1038, respectively, are parallel with the bore-sight 1030 of the assembly 1000, in an embodiment.

As discussed previously, conventional tile array configuration, beamformer modules and amplifier modules are connected so that their length and width dimensions are perpendicular to the bore-sight of the antenna. The minimum possible area of the beamformer and amplifier modules (e.g., length×width) is and will be constrained by current and future semiconductor manufacturing technologies. Because the beamformer modules and amplifier modules should fit within a space defined by 0.5λ, the maximum possible operational frequencies for conventional tile array configurations is restricted by the minimum possible area of the beamformer and amplifier modules.

Embodiments of the inventive subject matter may have an advantage over phased array antenna systems that include conventional tile array configured assemblies, because embodiments may be designed to operate at higher operational frequencies, given the state of current and future semiconductor manufacturing technologies. This is, at least in part, because the beamformer modules (e.g., modules 1014) and/or amplifier modules (e.g., modules 1016) may have areas that are larger than the areas of corresponding modules in conventional tile array configured assemblies. This is because the widths (e.g., widths 1036, 1038) of the beamformer and/or amplifier modules may expand in a direction parallel to the bore-sight or the assembly (e.g., direction 1030), in various embodiments. Accordingly, the dimensions of the beamformer and amplifier modules, of various embodiments, have a degree of dimensional freedom that is not present for conventional tile array configured assemblies.

Although two PWBs 1002 are shown to be connected to heat sink 1004, a single PWB may be connected to a heat sink, in an alternate embodiment. Further, although PWB 1002 is shown in FIG. 11 to have eight beamformer modules 1014 and amplifier modules 1016 connected thereto, more or fewer than eight beamformer modules 1014 and/or amplifier modules 1016 may be connected to a PWB 1002. In another alternate embodiment, orthogonal radiating elements 1008 may be excluded, and phased array antenna assembly 1000 may transmit signals using only one polarization, rather than two. In still other alternate embodiments, beamformer module 1014 and amplifier module 1016 may be implemented as a single module, or may be implemented as more than two modules. The term "module" is intended to refer to functionality, and not necessarily to an electronics module that is separately packaged.

Figure 12:
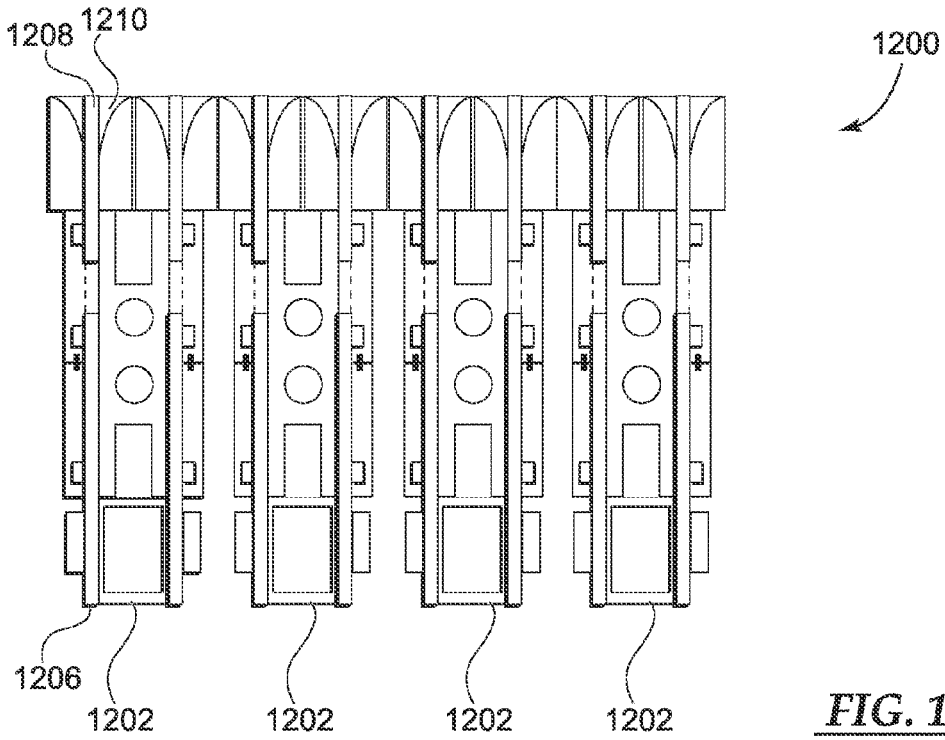
FIG. 12 illustrates side view of a plurality of antenna assemblies arranged in a matrix, in accordance with an example embodiment.

FIG. 12 illustrates side view of a plurality of antenna assemblies arranged in a matrix 1200, in accordance with an example embodiment. Matrix 1200 includes four assemblies 1202 arranged side-by-side, and each assembly 1204 includes two PWBs 1206. Assuming each PWB 1206 includes eight integral radiating elements 1208 and eight orthogonal radiating elements 1210 (e.g., as illustrated in FIG. 11), matrix 1200 may be characterized as including an 8×8 dual polarized phased array assembly. A matrix may be larger or smaller than the illustrated array, by including more or fewer assemblies. Further, although only a row of assemblies 1202 is illustrated in FIG. 12, assemblies can be arranged in rows and columns, or may be arranged only in columns, in other embodiments.

Figure 13:
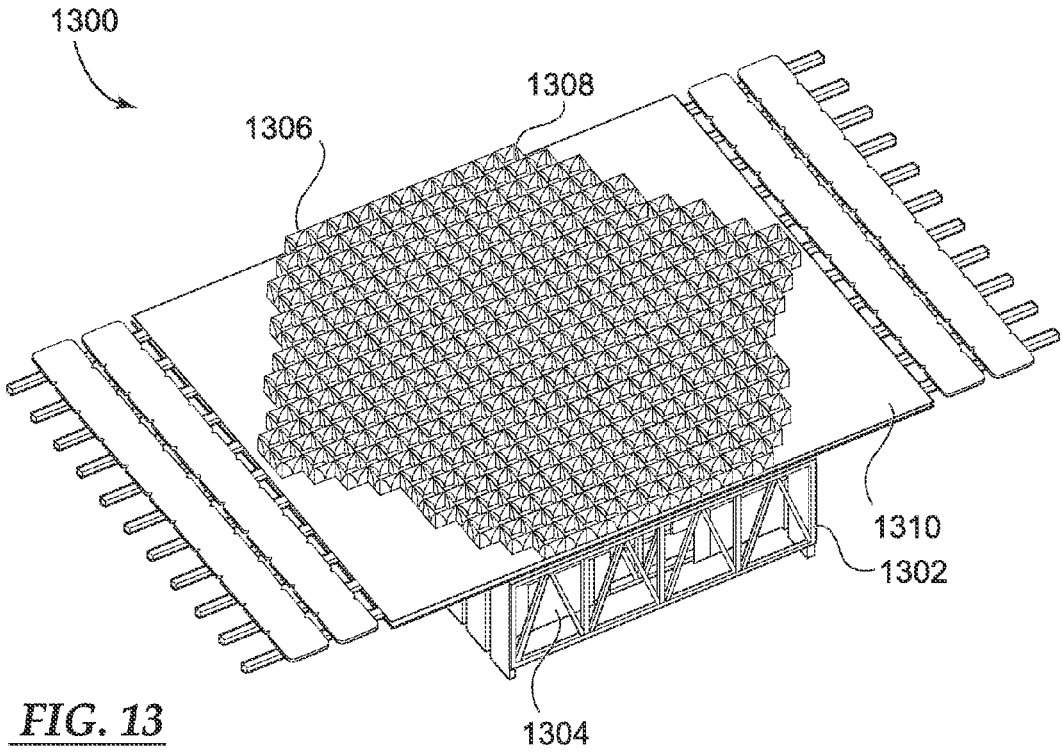
FIG. 13 illustrates a three-dimensional view of a phased array antenna system, in accordance with an example embodiment.

FIG. 13 illustrates a three-dimensional view of a phased array antenna 1300, in accordance with an example embodiment. Antenna 1300 includes a structure 1302 that houses multiple antenna assemblies 1304. Integral radiating elements 1306 and orthogonal radiating elements 1308 may extend beyond an aperture plain 1310 of the antenna 1300. Accordingly, antenna 1300 may accommodate a dual polarized system. In an alternate embodiment, orthogonal radiating elements 1308 may be excluded to accommodate a singly polarized system. Antenna 1300 includes a hexagonal shaped array. In other embodiments, an antenna may include a square, rectangular, or otherwise shaped array.

Figure 14:
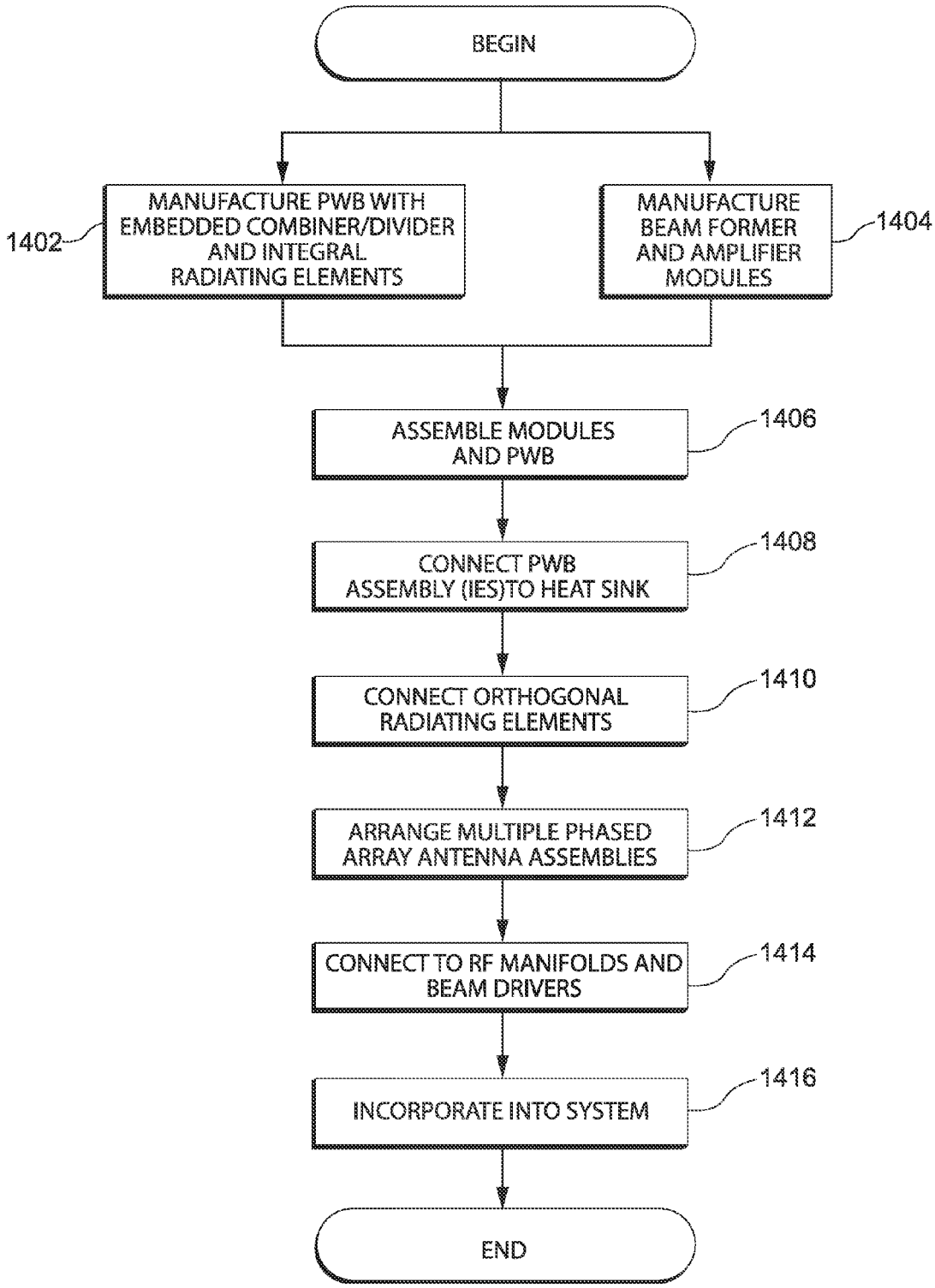
FIG. 14 illustrates a flowchart of a method for manufacturing a phased array antenna system, in accordance with an example embodiment.

FIG. 14 illustrates a flowchart of a method for manufacturing a phased array antenna system, in accordance with an example embodiment. The method may begin, in block 1402, by manufacturing a PWB that includes embedded interconnects (e.g., RF manifolds), DC lines, and control lines, which may be configured in accordance with various embodiments. In an embodiment, manufacturing the PWB includes forming the embedded interconnects, DC lines, and control lines by applying strip-line conductors on various ones of the PWB layers, laminating the layers, and forming vias to interconnect the layers. Manufacturing the PWB may also include forming an opening (e.g., opening 1026, FIG. 10) through the PWB, which is configured to enable an SSPA and/or a portion of an antenna module to directly contact a heat sink, as described previously in conjunction with FIG. 10.

Manufacturing the PWB may also include applying strip-line conductors on various ones of the PWB layers to provide interconnections between the radiating elements, the amplifier modules, and the beamformer modules, and etching end-launch radiating elements to an area of the PWB that corresponds to the radiating elements. In another embodiment, interconnections between the amplifier modules and the beamformer modules may include side-mounted interconnects on the modules, rather than interconnections through the PWB. The manufacturing processes described above may be performed in parallel, in some cases, and/or may be performed in different orders from those described. Further, manufacturing the PWB may include a number of additional processes that are not described herein for purposes of brevity.

In block 1404, which may be performed before, after or in parallel with block 1402, one or more modules may be manufactured, which implement embodiments of the inventive subject matter. For example, beamformer modules (e.g., beamformer modules 1014, FIG. 10) and amplifier modules (e.g., amplifier modules 1016, FIG. 10) may be manufactured, which are configured in accordance with various embodiments.

In block 1406, the PWB and the various modules may be assembled to produce a PWB assembly. In an embodiment, some or all of the modules may be connected to the PWB using spring-load connectors, as described previously. In other embodiments, some or all of the modules may be soldered into place and/or otherwise connected to PWB. In addition, other components (e.g., control electronics module 1010, input/output connectors 1012, and power control module 1011, FIG. 10) may be connected to the PWB. In an embodiment, some or all of the modules may be assembled with the PWB using automated pick-and place techniques for relatively low-cost, high-volume manufacturing.

In block 1408, one or more of the PWB assemblies may be connected to a heat sink (e.g., heat sink 1006, FIG. 10) and to other structural members. Orthogonal radiating elements (e.g., orthogonal radiating elements 1008, FIG. 10) may be connected to the integral radiating elements and/or to the PWB assembly, in block 1410.

The manufacturing processes described in conjunction with blocks 1402-1410 may result in a phased array antenna assembly, such as that illustrated in FIG. 10. In order to produce a larger array, multiple ones of the phased array antenna assemblies may be arranged together into a structure (e.g., structure 1302, FIG. 13), in block 1412.

The phased array antenna assemblies may then be connected to one or more RF manifolds and/or beam drivers, in block 1414, such as those described in conjunction with FIGS. 2 and 3. The resulting phased array antenna system may be incorporated into a larger system, in block 1416, such as a satellite communications system, a satellite radar system, or another type of system that uses a phased array antenna system to transmit and/or receive various types of signals. The method then ends.

Embodiments of the inventive subject matter may be incorporated into various types of systems, including but not limited to satellite communications systems, satellite radar systems, and terrestrially-based communications and/or radar systems. Embodiments of the inventive subject matter, described above, may provide one or more technical and/or economic benefits over traditional apparatus and methods. For example, embodiments may result in a phased array antenna system that weighs significantly less than TWT-based and traditional brick array architectures, by eliminating many of the cables and connectors that characterize those systems. In addition, embodiments may result in a phased array antenna system that has better yield and better reliability, by including a PWB having significantly fewer layers than conventional tile array configurations. Various embodiments also may result in a phased array antenna system that is characterized by better thermal performance.

While several exemplary embodiments have been presented in the foregoing detailed description, it should be appreciated that a vast number of variations exist. It should also be appreciated that the exemplary embodiments are only examples, and are not intended to limit the scope, applicability, or configuration of the described embodiments in any way. Rather, the foregoing detailed description will provide those skilled in the art with a convenient road map for implementing the exemplary embodiments. It should be understood that various changes can be made in the function and arrangement of elements without departing from the scope as set forth in the appended claims and the legal equivalents thereof.

What is claimed is:

1. A phased array antenna apparatus, comprising:

a first printed wiring board having multiple layers;

a plurality of interconnections embedded within the multiple layers, wherein the plurality of interconnections include a plurality of radio frequency (RF) manifolds;

at least one beam combiner/divider operably connected to the plurality of interconnections;

at least one amplifier operably connected to the at least one beam combiner/divider; and at least one integral radiating element operably connected to the at least one amplifier, and located proximate to an edge of the printed wiring board and oriented in parallel with a bore-sight of the phased array antenna apparatus.

2. The phased array antenna apparatus of claim 1, wherein the at least one beam combiner/divider comprises:

an H form combiner.

3. The phased array apparatus assembly of claim 2, wherein the H form combiner includes an H form combiner, which is implemented using multiple tiers.

4. The phased array antenna apparatus of claim 1, wherein the plurality of interconnections comprises:

a first strip-line RF manifold that interconnects a first set of corresponding ports of the at least one beam combiner/divider; and a second strip-line RF manifold that interconnects a second set of corresponding ports of at least one beam combiner/divider, wherein the first strip-line RF manifold and the second strip-line RF manifold are deposited on a same one of the multiple layers.

5. The phased array antenna apparatus of claim 1, wherein the at least one amplifier is oriented in parallel with the bore-sight of the phased array antenna apparatus.

6. The phased array antenna apparatus of claim 1, further comprising:

a heat sink to which the first printed wiring board is connected, wherein the first printed wiring board further includes an opening adapted to enable an amplifier to directly contact the heat sink.

7. The phased array antenna apparatus of claim 1, further comprising:

at least one orthogonal radiating element arranged orthogonally to the at least one integral radiating element and connected to the printed wiring board.

8. The phased array antenna apparatus of claim 1, wherein:

the at least one integral radiating element includes an end-launch radiating element etched onto a surface of the printed wiring board.

9. The phased array antenna apparatus of claim 1, wherein:

the at least one integral radiating element includes $2^n$ integral radiating elements arranged side-by-side along the top portion of the printed wiring board.

10. The phased array antenna apparatus of claim 1, further comprising:

a heat sink, wherein the first printed wiring board is connected to a first side of the heat sink; and a second printed wiring board connected to a second side of the heat sink.

11. A phased array antenna apparatus, comprising:

a plurality of phased array antenna assemblies arranged in a matrix, wherein each phased array antenna assembly includes a heat sink;

a first printed wiring board connected to a first side of the heat sink and having multiple layers;

a plurality of interconnections embedded within the multiple layers, wherein the plurality of interconnections include a plurality of radio frequency (RF) manifolds;

at least one beam combiner/divider operably connected to the plurality of interconnections;

at least one amplifier operably connected to the at least one beam combiner/divider; and at least one integral radiating element operably connected to the at least one amplifier, and located proximate to an edge of the printed wiring board and oriented in parallel with a bore-sight of the phased array antenna apparatus.

12. The phased array antenna apparatus of claim 11, wherein the at least one beam combiner/divider comprises:

an H form combiner.

13. The phased array antenna apparatus of claim 11, wherein the plurality of interconnections comprises:

a first strip-line RF manifold that interconnects a first set of corresponding ports of the at least one beam combiner/divider; and a second strip-line RF manifold that interconnects a second set of corresponding ports of at least one beam combiner/divider, wherein the first strip-line RF manifold and the second strip-line RF manifold are deposited on a same one of the multiple layers.

14. The phased array antenna apparatus of claim 11, further comprising:

an opening in the first printed wiring board adapted to enable an amplifier to directly contact the heat sink.

15. The phased array antenna apparatus of claim 11, wherein:

the at least one integral radiating element includes an end-launch radiating element etched onto a surface of the printed wiring board.

16. The phased array antenna apparatus of claim 11, further comprising:

a second printed wiring board connected to a second side of the heat sink.

17. A method for manufacturing a phased array antenna apparatus, the method comprising:

assembling one or more modules with a printed wiring board, wherein the printed wiring board includes multiple layers, a plurality of integral radiating elements, and a plurality of interconnections between corresponding ports of a plurality of beam combiners/dividers within a plurality of beamformer modules, and wherein the one or more modules include the plurality of beamformer modules and a plurality of amplifier modules; and connecting the printed wiring board to a heat sink to produce a phased array antenna assembly.

18. The method of claim 17, further comprising:

manufacturing the printed wiring board with a first strip-line RF manifold that interconnects a first set of corresponding ports of the plurality of beam combiners/dividers, and a second strip-line RF manifold that interconnects a second set of corresponding ports of the plurality of beam combiners/dividers, wherein the first strip-line RF manifold and the second strip-line RF manifold are deposited on a same one of the multiple layers.

19. The method of claim 17, further comprising:

manufacturing the printed wiring board with an opening adapted to enable an amplifier to directly contact the heat sink.

20. The method of claim 17, further comprising:

arranging at least one other phased array antenna assembly into a matrix with the first phased array antenna assembly.

* * * * *